US005935276A

United States Patent [19]

DeRosa et al.

[11] Patent Number: 5,935,276

[45] Date of Patent: Aug. 10, 1999

[54] METHOD OF IMPEDING THE EVAPORATION OF A SOLVENT AND COMPOSITIONS USEFUL THEREIN

[75] Inventors: Thomas F. DeRosa, Passaic, N.J.; Joseph M. Russo, Poughkeepsie, N.Y.; Benjamin J. Kaufman, Hopewell Junction, N.Y.; James R. Ketcham, Salt Point, N.Y.

[73] Assignee: Texaco Inc, White Plains, N.Y.

[21] Appl. No.: 08/902,096

[22] Filed: Jul. 29, 1997

[51] Int. Cl.[6] ..... C10L 1/16

[52] U.S. Cl. ..... 44/337; 585/14; 508/591; 510/405; 106/285; 422/42

[58] Field of Search ..... 585/14; 44/337; 422/42; 510/405; 106/285; 508/591

[56] References Cited

U.S. PATENT DOCUMENTS

| | | | |
|---|---|---|---|
| 3,607,350 | 9/1971 | Rathsack . | |
| 3,701,266 | 10/1972 | Chisholm . | |
| 3,910,856 | 10/1975 | Kruka et al. | 44/337 |
| 3,941,705 | 3/1976 | Foulletier et al. | 422/42 |
| 3,950,494 | 4/1976 | Guenthner | 422/42 |
| 3,956,554 | 5/1976 | Abel et al. . | |
| 3,959,154 | 5/1976 | Cox | 422/42 |
| 4,002,436 | 1/1977 | Osmond et al. | 44/337 |
| 4,035,149 | 7/1977 | Scott et al. | 422/42 |
| 4,104,244 | 8/1978 | Chuchin et al. . | |
| 4,235,743 | 11/1980 | Canevari | 422/42 |
| 4,243,416 | 1/1981 | Grourke et al. . | |
| 4,243,417 | 1/1981 | Grourke et al. . | |
| 4,268,411 | 5/1981 | Iwata et al. | 422/42 |
| 4,326,986 | 4/1982 | Canevari | 252/384 |
| 4,386,052 | 5/1983 | Canevari | 422/42 |
| 4,426,003 | 1/1984 | Zarov | 422/42 |
| 4,459,221 | 7/1984 | Hisamoto et al. | 422/42 |
| 4,506,037 | 3/1985 | Suzuki . | |
| 4,609,489 | 9/1986 | Hisamoto et al. | 422/42 |
| 4,629,633 | 12/1986 | Bespalov et al. | 422/42 |
| 4,647,291 | 3/1987 | Eckert | 44/337 |
| 4,663,067 | 5/1987 | Mallow et al. . | |
| 4,729,849 | 3/1988 | Hisamoto et al. | 422/42 |
| 4,925,668 | 5/1990 | Khan et al. . | |
| 4,954,135 | 9/1990 | Le | 44/337 |
| 5,021,160 | 6/1991 | Wolpert . | |
| 5,125,439 | 6/1992 | Perkins | 422/42 |
| 5,225,325 | 7/1993 | Miller et al. | 422/42 |
| 5,280,078 | 1/1994 | Gregor et al. . | |
| 5,296,164 | 3/1994 | Thach et al. | 422/42 |
| 5,434,192 | 7/1995 | Thach et al. | 422/42 |
| 5,462,768 | 10/1995 | Adkins et al. . | |
| 5,529,757 | 6/1996 | Kaufmann | 422/42 |

FOREIGN PATENT DOCUMENTS

| | | | |
|---|---|---|---|
| 1210857 | 2/1966 | Germany | 120/27 |

OTHER PUBLICATIONS

Synthesis and Characterization of Poly(vinylcyclohexane) Derivatives, by Mark D. Gehlsen, et al., *Journal of Polymer Science: Part B: Polymer Physics,* vol. 33, pp. 1527–1536, 1995.

Formation of Polmers Containing 4–Hydroxystyrene via Hydrolysis of 4–((Trimethylsilyl)oxy)styrene, by K. E. Uhrich, et al., *Macromolecules,* vol. 27, No. 18, pp. 4936–4940, 1994.

Segregation of Block Copolymer Micelles to Surfaces and Interfaces, by Kenneth R. Shull, et al., *Macromolecules,* vol. 24, No. 10, pp. 2748–2751, 1991.

Comb–like Triblock Copolymers by Wurtz–Grignard Coupling of Syndiotactic PMMA Anions to Poly[p–bromomethyl)styrene]–b–polyisobutylene–b–poly[p–bromomethyl-)styrene] by M. Györ, et al., *Polymer Bulletin,* vol. 32, pp. 155–162, 1994.

A Novel Synthesis of Organosilicon–Containing Polystyrenes with High Si Content and their Gas Permeability as Membrane, by Yukio Nagasaki, et al., *Macromolecles Rapid commun,* vol. 15, pp. 619–627 (1994.

Synthesis and Surface Characterization of Hydrophilic–Hydrophobic Block Copolymers Containing Poly(2,3–dihydroxypropl Methacrylate), by Hideharu Mori, et al, *Macromolecules,* vol. 27, pp. 4093–4100, 1994.

*Primary Examiner*—Jacqueline V. Howard
*Attorney, Agent, or Firm*—Henry H. Gibson; Arnold White & Durkee

[57] ABSTRACT

A method of impeding the evaporation of a solvent by at least partially dissolving a solvent soluble polymer in the solvent in sufficient amounts so as to impede the evaporation of the solvent is disclosed. In one embodiment the soluble polymer may be selected from the group including oligomeric or polymeric homo-, co-, and terpolymers wherein a vinylcyclohexyl moiety comprises at least 10% weight of the polymer. Another aspect is generally directed to a method of storing a solvent including placing the solvent in a suitable container for storage, and dissolving in at least a portion of the solvent sufficient amounts of a soluble polymer so as to impede the evaporation of the solvent. Also described are compositions including a solvent and a polymer dissolved in the solvent so as to impede evaporation of the solvent.

30 Claims, No Drawings

METHOD OF IMPEDING THE EVAPORATION OF A SOLVENT AND COMPOSITIONS USEFUL THEREIN

BACKGROUND OF THE INVENTION

1. Field of the Invention

The present invention is generally directed to a method of impeding the evaporation of organic solvents including fuels by using an oligomeric or polymeric materials dissolved in the solvent. Other aspects of this invention include a method of storing solvents while minimizing the evaporation of the solvent and the composition of the solvent/oligomer or the solvent/polymer mixture.

2. Background

Over the past few years there has been an increasing public awareness of environmental issues in particular air pollution. In even the smallest of cities and towns, air pollution is of concern to government officials because of its detrimental effects on health and quality of life. Smog is especially troublesome. Smog and smog-like toxins are generated when admixtures of nitric oxides, ($NO_x$) and volatile organic compounds (VOCs), such as aliphatic and aromatic hydrocarbons, ethers, ketones, aldehydes etc. are exposed to sunlight. The principle source of $NO_x$ is automobile exhaust although industrial and residential boilers and water heaters also contribute. Volatile organic compounds are generated by either incomplete combustion or evaporation of volatile liquids such as gasoline, diesel fuel, fuel oil, charcoal fluid, paint and lacquer thinner, cleaning solvents, non-detergent degreasers, etc. In many large metropolitan areas, special ordinances restricting use or handling and storage of liquids that form VOCs have been enacted and enforced. This in turn has caused the development of devices and technologies that contain or limit the release of VOCs into the air.

In addition, as a result of cost-prohibitive technological underdevelopment the petroleum industry has for many years known and grudgingly accepted the evaporation of gasoline, diesel fuel, kerosene, aviation fuel, etc. in these under-developed countries or remote regions of the world where such liquids are stored and used. Typically storage of even moderate amounts of these volatile liquids occurs in open or directly vented containers out of which a substantial portion of the liquid evaporates. Not only is the generation of VOCs of environmental concern, but the evaporation of the liquids adds to the cost of shipping, handling, storage and end use of these products.

A number of devices and technologies have been developed that reduce or contain the VOCs generated by the evaporation of volatile liquids. Examples include ventless storage tanks, and vapor recovery systems such as those used in automobile service stations, as well as industrial systems that cool the liquid or place a "cap" of inert or some other pressurized gas over the surface of the liquid. While effective, such systems are expensive to build and maintain and add to the difficulty of storage, transportation and transfer of the liquid. The cost of these technologies is too great for use in under-developed countries or remote locations. Thus there remains an unmet need for an inexpensive, simple method of impeding the evaporation of volatile liquids.

One such method and a composition useful carrying out that method is described by Canevari in U.S. Pat. Nos. 4,326,986 and 4,386,052. In the practice of the Canevari method, a mixture of a surfactant and an alkyl polyol is applied to the surface of crude oil, or other hydrocarbon liquid, so as to form a physical layer or thin film on the surface of the exposed surface of the liquid. Canevari characterizes the thin film being most effective when greater than 70 monolayers and preferably 210 to 350 monolayers thick on the surface. The mixture itself consists essentially of a surfactant, such as a commercially available foaming agent, which is not soluble in hydrocarbons and a polyol having a molecular weight between 100 and 1200 AMU, such as ethylene glycol. Ideally the mixture is applied to the crude oil surface by spraying or aerosolizing techniques to form the physical layer. Although not addressed by Canevari, it is reasonable to conclude that after transferring the liquid to a new container, the surface of the liquid in the new container must be re-treated to again minimize evaporation.

SUMMARY OF THE INVENTION

The present invention is generally directed to a method of impeding the evaporation of a solvent by utilizing a partially dissolved solvent-soluble polymer in the solvent in sufficient amounts so as to impede the evaporation of the solvent. "Partially dissolved" is a generic description of the thermodynamics associated with polymer dissolution. More precisely it reflects the structural behavior of an oligomer or polymer when placed into a solvent which is concurrently not a Flory solvent or a non-Flory solvent. Solvents skewed toward the non-Flory solvent side of the spectrum would more generally result in the macroscopic observation of polymer partial solubility. In one embodiment the soluble polymer may be selected from the group including oligomeric or polymeric homo-, co-, and terpolymers wherein a vinylcyclohexyl moiety comprises at least 10% weight of the polymer. The method is useful in the impediment of the evaporation of volatile liquids especially organic solvents or mixtures of solvents.

Another aspect of the present invention is generally directed to a method of storing a volatile solvent in a suitable container for storage and dissolving sufficient amount of a polymer in the volatile solvent so as to impede the evaporation of the volatile solvent. In one embodiment, the amount of polymer dissolved in the volatile solvent is sufficient enough to impede the evaporation of the volatile solvent under ambient conditions so as to give a cumulative advantage of at least 2% and preferably from about 2% to about 12%.

Yet another aspect of the present invention is the composition utilized in the above methods. The composition includes a solvent and a polymer, the polymer being semi-dissolved in the solvent in sufficient amounts so as to impede the evaporation of the solvent. In one embodiment the amount of polymer semi-dissolved in the solvent is in an amount so that the polymer has a concentration from 1 part per million (ppm) to as high as the solubility limit of the polymer in the solvent which is typically about 300 ppm. However, due to practical considerations, the concentration of polymer in this embodiment is preferably between about 1 ppm and 200 ppm.

DESCRIPTION OF ILLUSTRATIVE EMBODIMENTS

The following terms and phrases are used herein and are intended to have the following meaning:

"Cumulative evaporative reduction" is an empirical value used to determine the relative effectiveness of a poly mer on the evaporation of the solvent in which the polymer is dissolved. It is calculated using the following formula:

$$\text{Cumulative evaporative reduction} = \frac{[(\text{weight of test solvent}) - (\text{weight of control solvent})]}{\text{Total weight of solvent}}$$

"Terpolymer" is a polymer formed by the copolymerization of three unique monomers, to give a polymer having the general formula:

$$-(-(A)-(B)-(C)-)_n-$$

wherein A is a first monomer, B is a second and different monomer and C is a third and different monomer. The distribution of A, B, and C is random, "Block-terpolymer" is a polymer formed by the block polymerization of three different monomers, to give a polymer having the general formula:

$$-(A)_x-(B)_y-(C)_z-$$

wherein A is a first monomer, B is a second and different monomer, C is a third and different monomer and the values for x, y and z may be from 1 to greater than 1,000. Although A, B, and C are distributed in blocks throughout the polymer, the block distribution may be ordered or randomly incorporated in the desired polymer;

"Polycyclic aliphatic" is a polymer having cyclic, non-aromatic pendant groups where the pendant cyclic groups have at least 5 carbon atoms in the cyclic ring; for example, polyvinylcyclohexane has the general structure:

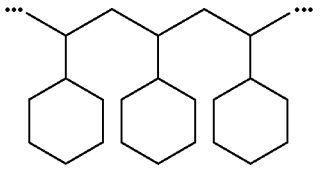

Percentage values for the amount of any particular component in a mixture is the percent by weight of the final mixture unless noted otherwise.

One aspect of the present invention is generally directed to a method for impeding the evaporation of volatile organic solvents under ambient conditions. More particularly, this aspect involves the semi-dissolving of a polymer in a solvent, the polymer being in sufficient amounts so as to impede the evaporation of a volatile liquid.

In the following detailed description, preferred embodiments and specific examples illustrating the invention use specific volatile organic liquids as the solvent. However, it will be apparent to one skilled in the art that evaporation of volatile organic solvents other than those specifically mentioned, will also be impeded when polymers of the present invention are dissolved in these solvents. Therefore it is within the scope of the present invention for the term solvent to include organic solvents that are volatile organic liquids selected from the group including: $C_3$ to $C_{20}$ straight chain, branched, cyclic and aromatic and polyaromatic hydrocarbons; $C_1$ to $C_{20}$ straight chain, branched, cyclic and aromatic alcohols and glycols; $C_1$ to $C_{20}$ straight chain, branched, cyclic and aromatic aldehydes: $C_3$ to $C_{20}$ straight chained, branched, cyclic and aromatic ketones; $C_3$ to $C_{20}$ straight chain, branched, cyclic and aromatic esters; $C_2$ to $C_{20}$ straight chain, branched cyclic and aromatic ethers; and reasonable combinations and permutations thereof. Further as used herein, the term "solvent" may also be a complex mixture(s) of volatile liquids. Therefore it is also within the scope of the present invention for the term solvent to include the impediment of the evaporation of liquids such as high and low Reed vapor pressure gasoline, diesel fuel, fuel oil, kerosene, naphtha, paraffin hydrocarbons, crude oil, high and low Reed pressure aviation gasoline, jet fuel, paint and lacquer thinners, turpentine, cleaning solvents, non-surfactant degreasers, methanol, ethanol, propanol, acetone, diethyl ether, methyl ethyl ketone, methyl t-butyl ether (MTBE), cyclic hydrocarbons such as cyclopentane, cyclohexane, and the like and combinations and mixtures thereof. It is again understood that this method of impeding evaporative emission is not restricted to the aforementioned solvents or solvent mixtures. These aforementioned solvents and solvent mixtures are provided as illustrations and examples of the solvents useful with this invention.

A wide range of synthetic and processed natural polymers may be used in the practice of the present inventive method. The general criteria for the selection of such polymers include: (1) the polymer should be at least partially soluble in the solvent to form a single solution phase; (2) the polymer should impede the evaporation of the solvent under ambient and slightly elevated temperature conditions commonly encountered during storage and handling; (3) the concentration of the polymer used to impede the evaporation should not adversely affect the normal and accepted use of the solvent. Polymers which have been found to be useful include those polymers in which at least 10% of the weight of the polymer is vinylcyclohexane. As the term is used herein, vinylcyclohexane is that part of the structure of a random or block oligomer or polymer that has the structure:

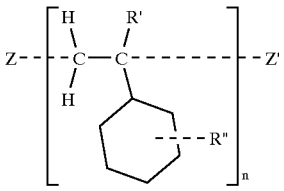

wherein the hexagon represents a cyclohexane ring, R' may be H, or $C_1$ to $C_6$ aliphatic alkyl group. R" may be H or $C_1$ to $C_6$ aliphatic alkyl group in any position on the cyclohexane ring, Z and Z' represent the oligomeric or polymeric chain, 'n' represents the repeat unit of the vinylcyclohexane-containing oligomer or polymer and has any positive integer value greater than zero.

Suitable polymers may be homo-, co-, and terpolymers containing at least 10% by weight of the vinylcyclohexyl structure. Preferred examples of suitable polymers may be selected from the group including polyvinylcyclohexane, α-methylpolyvinylcyclohexane. polyvinylmethylcyclohexane; polyvinyl-t-butylcyclohexane; polyvinylcyclohexane-b-polyethylene-b-polybutylene-b-polyvinylcyclohexane; polyvinylcyclohexane-b-polyethylene-b-polybutylene-b-poly[1,2-dihydroxyethane]; methylpolyvinylcyclohexane-b-polyethylene-b-polybutylene-b-α-methylpolyvinylcyclohexane; α-methylpolyvinylcyclohexane-b-polyethylene-b-polybutylene-b-poly[1,2-dihydroxyethane]; polyvinylmethylcyclohexane-b-polyethylene-b-polybutylene-b-polyvinylmethylcyclohexane; polyvinylmethylcyclohexane-b-polyethylene-b-polybutylene-b-poly[1,2-dihydroxyethane]; polyvinyl-t-butylcyclohexane-b-polyethylene-b-polybutylene-b-polyvinyl-t-butylcyclohexane; polyvinyl-t-butylcyclohexane-b-polyethylene-b-polybutylene-b-poly[1,2-dihydroxyethane]; polyvinyl tetraline and, mixtures thereof. One of ordinary skill in the art should know that in the above formulas the blocks of block polymers are denoted with a "-b-". For example, a block copolymer comprising a polyethylene block and a polyvinylcyclohexane block would be denoted as polyethylene-b-polyvinylcyclohexane. The average molecular weight of the polymers used to impede solvent evaporation are preferably from about 640 AMU to about 300,000 AMU with a concurrent preferred polydispersity from about 1.1 to about 3.5.

In one embodiment of the present inventive method, polyvinylcyclohexane, made from the catalytic hydrogenation of polystyrene, may be utilized to impede the evaporation of gasoline. In another embodiment of the present invention, α-methyl-polyvinylcyclohexane, generated from the hydrogenation of α-methyl-polystyrene, may be dissolved in gasoline so as to achieve a cumulative evaporative reduction in the range of between about 2% and about 12%. A third embodiment of this invention utilizes a hydrogenated block terpolymer of polystyrene-b-polybutylene-b-polyethylene-b-polystyrene to impede the evaporation of aviation fuel. In a fourth embodiment of this invention a catalytically hydrogenated Kraton Rubber block polymer consisting of poly[(styrene-b-ethylene)-b-(butadiene-b-styrene)] is hydrogenated to generate poly[(vinylcyclohexane-b-ethylene)-b-(ethylene-b-vinylcyclohexane)] and then dissolved in gasoline to impede evaporation. Yet another embodiment of the inventive method uses a hydrogenated Kraton rubber block polymer of poly[[styrene-b-ethylene)-b-(butadiene-b-styrene)]-b-maleic anhydride] dissolved in kerosene so as to impede the evaporation.

One of the several aspects of the present invention is the range of polymer concentrations used to impede the evaporation of the solvent. Concentrations as low as about 1 ppm and in excess of 250 ppm have been found effective in impeding the evaporation of solvent. The practical limitation of the maximum amount of polymer that may be used for any particular solvent/polymer combination is the solubility limit of the polymer in that solvent. However, for most practical applications as in gasoline fuel for internal combustion engines a saturated solution of polymer/gasoline will potentially cause the gumming and fouling of carburetor jets, fuel injection nozzles and other internal mechanisms. Therefore in such applications the upper limit of polymer dissolved gasoline also depends upon the amount of gumming and fouling acceptable for the smooth performance of the engine in addition to evaporative emission considerations. Ideally the concentration of polymer dissolved fuels is from about 5 ppm to about 50 ppm for applications in which the polymer/solvent is to be used for fuel in engines, turbines. and the like.

Another aspect of the present invention is the extent to which the polymer impedes the evaporation of organic solvents. For the purposes of the present disclosure, this aspect is based on the Cumulative evaporative reduction calculated from experimental data as previously defined above. The normalized average of the weight of solvent lost to evaporation by at least three and preferable five samples of the polymer/solvent liquid and the solvent without the polymer, with respect to time at the specified temperature. The method and compositions of the present invention achieve a Cumulative evaporative reduction of at least about 2% and preferably between about 2% and about 12%.

The exact mechanism or role or manner in which the dissolved polymer impedes the evaporation of the solvent is not fully understood. Although not intending to be bound by or limited to any particular theory or mechanism of action, we suggest that the success of this invention is a result of the unique intersection of the polymer with the solvent. More specifically, the intersection of vinylcyclohexane with the solvent is important for the evaporative effects of the solvent to become diminished. We further suggest that the diminished solubility of vinylcyclohexane with the non-Flory solvent causes polymer layering at the air interface. That is to say, as the polymer molecules collect at the air-liquid interface, polymer layer or layers form a molecular barrier that in turn impedes the evaporation of the solvent molecules. Another mechanism or manner in which the polymers may impede the evaporation of the solvent is the sequestering of the more volatile components of the solvent by the polymer. In this scenario, the evaporation of volatile molecules of the solvent penetrate the molecular polymer matrix and, therefore, must diffuse through the polymer barrier at the surface before they can evaporate. Since diffusion through any barrier is temperature dependent, solvents at ambient temperature or slightly elevated temperatures, would be expected to demonstrate the enhanced cumulative evaporative reduction. Regardless of the actual mechanism or theoretical role of the polymers in impeding the evaporation of the solvent, it is the result and the compositions achieving that result that are the focus of the present invention.

Another aspect of the present invention is a method of storing volatile liquids so as to reduce the amount of evaporation of the liquid and thereby the generation of VOCs. As mentioned above, in many parts of the world, it is conventional to store these liquids in covered, partially covered or even open containers which are vented directly to the surrounding air. Not only are such storage conditions of safety and environmental concern, there is also a substantial loss of the valuable fluid to the air. Therefore, methods of storing volatile liquids into which a polymer as described above is dissolved, are considered to be within the scope of this invention.

In general, the method includes placing the solvent to be stored in a suitable container and dissolving in at least a portion of the solvent sufficient amounts of a soluble or semi-soluble polymer so as to impede evaporation of the solvent. Suitable polymers may be selected from the group including oligomeric or polymeric homo-, co-, and terpolymers in which a vinylcyclohexyl moiety comprises at least 10% weight of the polymer. Examples of suitable polymers include polyvinylcyclohexane, α-methylpolyvinylcyclohexane, polyvinylmethylcyclohexane; polyvinyl-t-butylcyclohexane; polyvinylcyclohexane-b-polyethylene-b-polybutylene-b-polyvinylcyclohexane, polyvinylcyclohexane-b-polyethylene-b-polybutylene-b-poly[1,2-dihydroxy]; α-methylpolyvinylcyclohexane-b-polyethylene-b-polybutylene-b-α-methylpolyvinylcyclohexane; α-methylpolyvinylcyclohexane-b-polyethylene-b-polybutylene-b-poly[1,2-dihydroxyethane]; polyvinylmethylcyclohexane-b-polyethylene-b-polybutylene-b-polyvinylmethylcyclohexane; polyvinylmethylcyclohexane-b-polyethylene-b-polybutylene-b-poly[1,2-dihydroxyethane]; polyvinyl-t-butylcyclohexane-b-polyethylene-b-polybutylene-b-polyvinyl-t-butylcyclohexane; polyvinyl-t-butylcyclohexane-b-polyethylene-b-polybutylene-b-poly[1,2-dihydroxyethane]; polyvinyl tetraline and, mixtures thereof. In one embodiment the polymer is dissolved in the solvent in sufficient amounts so as to give a cumulative evaporative reduction of at least 2% and preferably from about 2% to about 12%. In another embodiment, the amount of polymer dissolved in the solvent is from about 1 ppm to the solubility limit of the polymer in the solvent. In a third embodiment the polymer is dissolved in the solvent and has a concentration from about 1 ppm to about 200 ppm. A wide variety of suitable volatile organic liquids may be used as the solvent. Examples of these solvents have been given above, reference to which is here made.

In one embodiment of the inventive method, sufficient quantities of the polymer are dissolved in the solvents previously noted at the refinery and thus throughout shipment, storage and use, the concentration of polymer in the polymer/solvent mixture remains within the desired range. In another embodiment of this art, a concentrated solution of the polymer is prepared and subsequently distributed to unadditized solvents. This high concentration polymer/solvent solution is then layered on top of the pure solvent so as to give a concentrated polymer/solvent layer.

This latter embodiment is particularly preferred in bulk industrial storage of liquids, such as gasoline diesel fuel, fuel oil, crude oil, aviation fuel, and so forth, in large containers (greater than 100 barrels) located at storage facilities. In this latter embodiment, the diffusion of polymer into the bulk of the solvent will be negligible as a result of the polyvinylcyclohexane's tendency toward remaining at the solvent/air interface. One skilled in the industrial arts should appreciate that it is conventional to add or remove solvent from the bottom of the bulk storage container. By doing so a minimal amount stirring or mixing may occur while a high concentration of homo-, co-, or terpolymer containing a polyvinylcyclohexane moiety remains at the surface while the concentration in the bulk solvent will be minimal.

Yet another aspect of the present invention is the solvent compositions resulting from the dissolution of polymer in solvent. Such compositions include a solvent and a polymer dissolved in the solvent in sufficient amounts so as to impede the evaporation of the solvent. As previously noted, the polymer may be selected from the group including oligomeric or polymeric homo-, co-, and terpolymers in which the vinylcyclohexyl moiety comprises at least 10% weight of the polymer. In one embodiment the polymer may be selected from the group including polyvinylcyclohexane, α-methylpolyvinylcyclohexane, polyvinylmethylcyclohexane; polyvinyl-t-butylcyclohexane; polyvinylcyclohexane-b-polyethylene-b-polybutylene-b-polyvinylcyclohexane; polyvinylcyclohexane-b-polyethylene-b-polybutylene-b-poly[1.2-dihydroxyethane]; α-methylpolyvinylcyclohexane-b-polyethylene-b-polybutylene-b-α-methylpolyvinylcyclohexane; α-methylpolyvinylcyclohexane-b-polyethylene-b-polybutylene-b-poly[1,2-dihydroxyethane]; polyvinylmethylcyclohexane-b-polyethylene-b-polybutylene-b-polyvinylmethylcyclohexane; polyvinylmethylcyclohexane-b-polyethylene-b-polybutylene-b-poly[1,2-dihydroxyethane]; polyvinyl-t-butylcyclohexane-b-polyethylene-b-polybutylene-b-polyvinyl-t-butylcyclohexane; polyvinyl-t-butylcyclohexane-b-polyethylene-b-polybutylene-b-poly[1,2-dihydroxyethane]; polyvinyl tetraline and, mixtures thereof. In one specific embodiment the polymer should be dissolved in the solvent so as to impede the evaporation of the solvent under ambient conditions so as to give a Cumulative evaporative reduction of at least about 2% and preferably from about 2% to about 12%. In another embodiment, the polymer is dissolved in the solvent so that the amount is from about 1 ppm to the solubility limit of the polymer in the solvent. For most practical purposes the polymer should have a concentration from about 1 ppm to about 200 ppm. Suitable solvents for the above compositions include those volatile liquids selected from the groups previously disclosed above and to which reference is here made.

The following examples are included to demonstrate and illustrate preferred embodiments of the invention. It should be appreciated by those of skill in the art that the techniques disclosed in these examples represent techniques discovered by the inventors and can be considered to constitute preferred modes for its practice. However, those of skill in the art should, in light of the present disclosure, appreciate that logical permutations of what has been described herein may exist. Such permutations may be related to structural aspects of the polymer, variation in the selection of the solvent, or variations in the empirically determined method of preparing the actual experiment. However, one skilled in the art should know that despite such permutations, one can obtain a like or similar result without departing from the spirit and scope of the invention. For example, the essential criterion for achieving Cumulative evaporative reduction of any fluid is the presence of vinylcyclohexane in the polymer structure; randomly or in blocks. Thus, one or both termini may contain unique structural groups; the co-, or terpolymer may contain a wide variety of structures not specifically described herein; the co-, or terpolymer may be a random or a block polymer, the co-, or terpolymer may contain derivatives of the structures disclosed herein; and all other chemically viable permutations are considered to be with in the scope of the invention provided that the polymer contains a vinylcyclohexane content of at least 10% weight and preferably a content from 20% weight to about 70% weight.

EXAMPLE 1

Preparation of α-methyl-polyvinylcyclohexane

Preparation of α-methyl-polyvinylcyclohexane was carried out using α-methyl-polystyrene having a molecular weight of approximately 640 AMU obtained from PolySciences, Inc. The styrene polymer was reduced in a 500 ml Parr reactor using unreduced palladium on barium sulfate, using 1:9 v/v tetrahydrofuran/cyclohexane solvent mixture. The reactor was charged with 10 g of the α-methyl-polystyrene, 10 g of catalyst and 300 ml of solvent and sufficient hydrogen gas to achieve a pressure of 1500 psig. The reaction was electrically heated to 100° C. for 24 hours during which is was vigorously rocked. The product was isolated by vacuum stripping the solvent from the reaction mixture. About 0.5% of the aromatics remained unreduced as determined by $^{13}C$ NMR.

EXAMPLE 2

Reduction of Polystyrene Contained in a Co- or Terpolymer to the Corresponding Vinylcyclohexane The aforementioned procedure may be used to reduce oligomers or polymers having substituted or unsubstituted polystyrene as part of its composition.

At the completion of these reductions products having an aromatic content of 5% or greater are not used in evaporation studies.

EXAMPLE 3

Evaluation of the Efficacy to Reduce the Evaporation of a Fluid

Case I: α-methyl-polyvinylcyclohexane

Studies were conducted using various amount of using α-methyl-polyvinylcyclohexane dissolved in unadditized gasoline. Typically about 30 ml to about 750 ml of solution containing an appropriate amount of polymer was prepared and distributed equally in three, 1 dram glass containers having a 20 mm diameter opening. The weight of each container was obtained as a function of time and the percent evaporative reduction was calculated. As a control, three identical 1 dram glass containers containing gasoline without polymer were prepared and weighed at about the same time.

The evaporative data after 120 hours are given in Table 1 below.

TABLE 1

| Sample Constantly Agitated | Polymer in Sample (wt %) | Cumulative Loss (%) | Evaporative Reduction (%) |
|---|---|---|---|
| No | 0.5 | 17.76 | 3.86 |
| No | 0.001 | 18.59 | 3.03 |
| No | 0.0005 | 20.14 | 1.48 |
| No | 0 | 21.62 | 0 |
| Yes | 0.5 | 15.42 | 1.68 |
| Yes | 0.001 | 15.69 | 1.40 |
| Yes | 0.0005 | 17.37 | 0.28 |
| Yes | 0 | 17.09 | 0 |

In view of the above data shown in Table 1, one skilled in the art should notice that samples in which polymer was present had a reduced Cumulative loss upon standing and constant agitation, although the effect is less evident in the latter case. Further upon examination it should be noted that when the amount of polymer is reduced from 0.5 wt % to 0.001 wt % the evaporative reduction does not decrease in an equal proportion.

Case II: α-methyl-polyvinylcyclohexane

An α-methyl-polyvinylcyclohexane having about 6% aromatic groups and a MW of about 640 was prepared using the method of Example 1. The effect on evaporative reduction was tested in accordance with Case 1 above. The evaporative data after 120 hours are given in Table 2 below.

TABLE 2

| Sample Constantly Agitated | Polymer in Sample (wt %) | Cumulative Loss (%) | Evaporative Reduction (%) |
|---|---|---|---|
| No | 0.5 | 19.72 | 1.90 |
| No | 0.001 | 20.65 | 0.97 |
| No | 0.0005 | 20.15 | 1.46 |
| No | 0 | 21.62 | 0 |
| Yes | 0.5 | 16.90 | 0.20 |
| Yes | 0.001 | 17.11 | −0.01 |
| Yes | 0.0005 | 15.82 | 1.28 |
| Yes | 0 | 17.09 | 0 |

In view of the above data shown in Table 1. one skilled in the art should notice that samples in which polymer was present had a reduced Cumulative loss upon standing and constant agitation, although the effect is less evident in the latter case. Further upon examination it should be noted that when the amount of polymer is reduced from 0.5 wt % to 0.001 wt % the evaporative reduction does not decrease in an equal proportion.

Case III: Polyvinylcyclohexane-b-polyethylene-b-polybutylene-b-poly[1,2-dihydroxyethane The polymer sample was prepared in a manner similar to Example 2. This test was carried out in a manner similar to that described above in Case 1. After 120 hours fuel additized with 15 ppm in this case had Cumulative evaporative emissions 8.6% lower than unadditized fuel.

Case IV: [polyvinylcyclohexane-b-polyethylene]-b-[polybutylene-b-poly[1,2-dihydroxyethane]

The polymer sample was prepared in a manner similar to Example 2. This test was carried out in a manner similar to that described above in Case 1. After 120 hours fuel additized with 50 ppm in this case had Cumulative evaporative emissions 12.2% lower than unadditized fuel.

Case V: Polyvinyl[(2-methyl)cyclohexane]

The polymer sample was prepared in a manner similar to Example 1. This test was carried out in a manner similar to that described above in Case 1. After 120 hours fuel additized with 25 ppm in this case had Cumulative evaporative emissions 9.3% lower than unadditized fuel.

Case VI: Polyvinyl[(3-methyl)cyclohexane]

The polymer sample was prepared in a manner similar to Example 1. This test was carried out in a manner similar to that described above in Case 1. After 120 hours fuel additized with 20 ppm in this case had Cumulative evaporative emissions 4.1% lower than unadditized fuel.

Case VII: Polyvinyl[(4-methyl)cyclohexane]

The polymer sample was prepared in a manner similar to Example 1. This test was carried out in a manner similar to that described above in Case 1. After 120 hours fuel additized with 50 ppm in this case had Cumulative evaporative emissions 8.7% lower than unadditized fuel.

Case VIII: Polyvinyl[4-t-butyl)cyclohexane]

The polymer sample was prepared in a manner similar to Example 1. This test was carried out in a manner similar to that described above in Case 1. After 120 hours fuel additized with 50 ppm in this case had Cumulative evaporative emissions 1.7% lower than unadditized fuel.

Case IX: Polyvinyl-tetraline

The polymer sample was prepared in a manner similar to Example 1. This test was carried out in a manner similar to that described above in Case 1. After 120 hours fuel additized with 50 ppm in this case had Cumulative evaporative emissions 3.2% lower than unadditized fuel.

Case X: Polyvinyl α-methyl-tetraline

The polymer sample was prepared in a manner similar to Example 1. This test was carried out in a manner similar to that described above in Case 1. After 120 hours fuel additized with 25 ppm in this case had Cumulative evaporative emissions 7.3% lower than unadditized fuel.

While the compositions and methods of this invention have been described in terms of preferred embodiments, it will be apparent to those of skill in the art that variations may be applied to the process described herein without departing from the concept, spirit and scope of the invention. All such similar substitutes and modifications apparent to those skilled in the art are deemed to be within the spirit, scope and concept of the invention as it is set out in the following claims.

What is claimed is:

1. A method for impeding the evaporation of an organic solvent comprising, dissolving a soluble polymer in the solvent in sufficient amounts so as to impede the evaporation of the solvent, wherein the amount of polymer dissolved in the organic solvent impedes the evaporation of the organic solvent under ambient conditions so as to give a cumulative evaporative reduction from about 2% to about 12%.

2. The method of claim 1 wherein the soluble polymer is selected from the group consisting of oligomeric or polymeric homo-, co-, and terpolymers wherein vinylcyclohexyl moiety comprises at least 10% weight of thc polymer.

3. The method of claim 2 wherein the solvent is a volatile liquid selected from the group consisting of $C_3$ to $C_{20}$ straight chain, branched, cyclic, aromatic and polyaromatic hydrocarbons; $C_1$ to $C_{20}$ straight chain, branched, cyclic and aromatic alcohols and glycols; $C_1$ to $C_{20}$ straight chain, branched, cyclic and aromatic aldehydes. $C_3$ to $C_{20}$ straight chained, branched, cyclic and aromatic ketones; $C_3$ to $C_{20}$ straight chain, branched, cyclic and aromatic esters; $C_1$ to $C_{20}$ straight chain, branched cyclic and aromatic ethers; and, combinations thereof.

4. The method of claim 2 wherein the solvent is selected from the group consisting of high and low Reed Vapor Pressure gasoline, diesel fuel, fuel oil, kerosene, naphtha, paraffin hydrocarbons, crude oil, high and low Reed Vapor Pressure aviation gasoline, jet fuel, paint and lacquer thinners, turpentine, cleaning solvents, non-surfactant degreasers, methanol, ethanol, propanol, acetone, diethyl ether, methyl ethyl ketone, methyl t-butyl ether, cyclic aliphatic solvents and combinations thereof.

5. The method of claim 2 wherein the amount of polymer dissolved in the solvent is from about 1 ppm to about 200 ppm.

6. The method of claim 1 wherein the soluble polymer is selected from the group consisting of polyvinylcyclohexane, α-methylpolyvinylcyclohexane, polyvinylmethylcyclohexane; polyvinyl-t-butylcyclohexane; polyvinylcyclohexane-b-polyethylene-b-polybutylene-b-polyvinylcyclohexane; polyvinylcyclohexane-b-polyethylene-b-polybutylene-b-poly[1,2-dihydroxyethane]; α-methylpolyvinylcyclohexane-b-polyethylene-b-polybutylene-b-α-methylpolyvinylcyclohexane; α-methylpolyvinylcyclohexane-b-polyethylene-b-polybutylene-b-poly[1,2-dihydroxyethane]; polyvinylmethylcyclohexane-b-polyethylene-b-polybutylene-b-polyvinylmethylcyclohexane; polyvinylmethylcyclohexane-b-polyethylene-b-polybutylene-b-poly[1,2-dihydroxyethane]; polyvinyl-t-butylcyclohexane-b-polyethylene-b-polybutylene-b-polyvinyl-t-butylcyclohexane; polyvinyl-t-butylcyclohexane-b-polyethylene-b-polybutylene-b-poly[1,2-dihydroxyethane]; polyvinyl tetraline and, mixtures thereof.

7. The method of claim 6 wherein the amount of polymer dissolved in the solvent is from about 1 ppm to the solubility limit of the polymer in the solvent.

8. The method of claim 6 wherein the amount of polymer dissolved in the solvent impedes the evaporation of the solvent under ambient conditions so as to give a cumulative evaporative reduction of at least 2%.

9. A method of storing an organic solvent comprising:

placing the organic solvent in a suitable container for storage, and dissolving in at least a portion of the organic solvent sufficient amounts of a soluble polymer so as to impede the evaporation of the organic solvent.

10. The method of claim 9 wherein the soluble polymer is selected from the group consisting of oligomeric or polymeric homo-, co-, and terpolymers wherein vinylcyclohexyl moiety comprises at least 10% weight of the polymer.

11. The method of claim 10 wherein the solvent is a volatile liquid selected from the group consisting of $C_3$ to $C_{20}$ straight chain, branched, cyclic, aromatic and polyaromatic hydrocarbons, $C_1$ to $C_{20}$ straight chain, branched, cyclic and aromatic alcohols and glycols; $C_1$ to $C_{20}$ straight chain, branched, cyclic and aromatic aldehydes; $C_3$ to $C_{20}$ straight chained, branched, cyclic and aromatic ketones; $C_3$ to $C_{20}$ straight chain, branched, cyclic and aromatic esters; $C_2$ to $C_{20}$ straight chain, branched cyclic and aromatic ethers; and, combinations thereof.

12. The method of claim 11 wherein the amount of polymer dissolved in the solvent impedes the evaporation of the solvent under ambient conditions so as to give a cumulative evaporative reduction of at least 2%.

13. The method of claim 12 wherein the amount of polymer dissolved in the solvent impedes the evaporation of the solvent under ambient conditions so as to give a cumulative evaporative reduction from about 2% to about 12%.

14. The method of claim 10 wherein the solvent is selected from the group consisting of high and low Reed Vapor Pressure gasoline, diesel fuel, fuel oil, kerosene, naphtha, paraffin hydrocarbons, crude oil, high and low Reed Vapor Pressure aviation gasoline, jet fuel, paint and lacquer thinners, turpentine, cleaning solvents, non-surfactant degreasers, methanol, ethanol, propanol, acetone, diethyl ether, methyl ethyl ketone, methyl t-butyl ether, cyclic aliphatic solvents and combinations thereof.

15. The method of claim 14 wherein the amount of polymer dissolved in the solvent is from about 1 ppm to the solubility limit of the polymer in the solvent.

16. The method of claim 15 wherein the amount of polymer dissolved in the solvent is from about 1 ppm to about 200 ppm.

17. The method of claim 9 wherein the soluble polymer is selected from the group consisting of polyvinylcyclohexane, α-methylpolyvinylcyclohexane, polyvinylmethylcyclohexane; polyvinyl-t-butylcyclohexane, polyvinylcyclohexane-b-polyethylene-b-polybutylene-b-polyvinylcyclohexane; polyvinylcyclohexane-b-polyethylene-b-polybutylene-b-poly[1,2-dihydroxyethane]; α-methylpolyvinylcyclohexane-b-polyethylene-b-polybutylene-b-α-methylpolyvinylcyclohexane; α-methylpolyvinylcyclohexane-b-polyethylene-b-polybutylene-b-poly[1,2-dihydroxyethane]; polyvinylmethylcyclohexane-b-polyethylene-b-polybutylene-b-polyvinylmethylcyclohexane; polyvinylmethylcyclohexane-b-polyethylene-b-polybutylene-b-poly[1,2-dihydroxyethane]; polyvinyl-t-butylcyclohexane-b-polyethylene-b-polybutylene-b-polyvinyl-t-butylcyclohexane; polyvinyl-t-butylcyclohexane-b-polyethylene-b-polybutylene-b-poly[1,2-dihydroxyethane]; polyvinyl tetraline and, mixtures thereof.

18. The method of claim 17 wherein the amount of polymer dissolved in the solvent is from about 1 ppm to about 200 ppm.

19. The method of claim 17 wherein the amount of polymer dissolved in the solvent impedes the evaporation of the solvent under ambient conditions so as to give a cumulative evaporative reduction from about 2% to about 12%.

20. A composition comprising, an organic solvent, and a polymer, the polymer being dissolved in the organic solvent in sufficient amounts so as to impede the evaporation of the organic solvent, wherein the polymer is selected from the group consisting of oligomeric or polymeric homo-, co-, and terpolymers wherein the presence of vinylcyclohexyl comprises at least 10% weight of the polymer and wherein the amount of polymer dissolved in the solvent impedes the evaporation of the solvent under ambient conditions so as to give a cumulative evaporative reduction from about 2% to about 12%.

21. The composition of claim 20 wherein the amount of polymer dissolved in the solvent is from about 1 ppm to about 200 ppm.

22. The composition of claim 20 wherein the polymer is selected from the group consisting of polyvinylcyclohexane, α-methylpolyvinylcyclohexane, polyvinylmethylcyclohexane; polyvinyl-t-butylcyclohexane; polyvinylcyclohexane-b-polyethylene-b-polybutylene-b-polyvinylcyclohexane; polyvinylcyclohexane-b-polyethylene-b-polybutylene-b-poly[1,2-dihydroxyethane]; α-methylpolyvinylcyclohexane-b-polyethylene-b-polybutylene-b-α-methylpolyvinylcyclohexane; α-methylpolyvinylcyclohexane-b-polyethylene-b-polybutylene-b-poly[1,2-dihydroxyethane]; polyvinylmethylcyclohexane-b-polyethylene-b-polybutylene-b-polyvinylmethylcyclohexane; polyvinylmethylcyclohexane-b-polyethylene-b-polybutylene-b-poly[1,2-dihydroxyethane]; polyvinyl-t-butylcyclohexane-b-polyethylene-b-polybutylene-b-polyvinyl-t-butylcyclohexane; polyvinyl-t-butylcyclohexane-b-polyethylene-b-polybutylene-b-poly[1,2-dihydroxyethane]; polyvinyl tetraline and, mixtures thereof.

23. The composition of claim 22 wherein the solvent is a volatile liquid selected from the group consisting of $C_3$ to $C_{20}$ straight chain, branched, cyclic, aromatic and polyaromatic hydrocarbons; $C_1$ to $C_{20}$ straight chain, branched, cyclic and aromatic alcohols and glycols; $C_1$ to $C_{20}$ straight chain, branched, cyclic and aromatic aldehydes; $C_3$ to $C_{20}$ straight chained, branched, cyclic and aromatic ketones; $C_3$ to $C_{20}$ straight chain, branched, cyclic and aromatic esters; $C_2$ to $C_{20}$ straight chain, branched cyclic and aromatic ethers; and, combinations thereof.

24. The composition of claim 23 wherein the amount of polymer dissolved in the solvent is from about 1 ppm to the solubility limit of the polymer in the solvent.

25. The composition of claim 24 wherein the amount of polymer dissolved in the solvent is from about 1 ppm to about 200 ppm.

26. The composition of claim 22 wherein the solvent is selected from the group consisting of high and low Reed Vapor Pressure gasoline, diesel fuel, fuel oil, kerosene, naphtha, paraffin hydrocarbons, crude oil, high and low Reed Vapor Pressure aviation gasoline, jet fuel, paint and lacquer thinners, turpentine, cleaning solvents, non-surfactant degreasers, methanol, ethanol, propanol, acetone, diethyl ether, methyl ethyl ketone, methyl t-butyl ether, cyclic aliphatic solvents and combinations thereof.

27. The composition of claim 26 wherein the amount of polymer dissolved in the solvent impedes the evaporation of the solvent under ambient conditions so as to give a cumulative evaporative reduction of at least 2%.

28. The composition of claim 27 wherein the amount of polymer dissolved in the solvent impedes the evaporation of the solvent under ambient conditions so as to give a cumulative evaporative reduction from about 2% to about 12%.

29. A method for impeding the evaporation of an organic solvent comprising, dissolving a soluble polymer in the solvent in sufficient amounts so as to impede the evaporation of the organic solvent wherein the polymer is selected from the group consisting of oligomeric or polymeric homo-, co-, and terpolymers wherein the presence of vinylcyclohexyl comprises at least 10% weight of the polymer and wherein the amount of polymer dissolved in the organic solvent impedes the evaporation of the organic solvent under ambient conditions so as to give a cumulative evaporative reduction from about 2% to about 12%.

30. A method of storing an organic solvent comprising:

placing the organic solvent in a suitable container for storage, and dissolving in at least a portion of the organic solvent sufficient amounts of a soluble polymer so as to impede the evaporation of the organic solvent, wherein the polymer is selected from the group consisting of oligomeric or polymeric homo-, co-, and terpolymers wherein the presence of vinylcyclohexyl comprises at least 10% weight of the polymer and wherein the amount of polymer dissolved in the organic solvent impedes the evaporation of the solvent under ambient conditions so as to give a cumulative evaporative reduction from about 2% to about 12%.

* * * * *

UNITED STATES PATENT AND TRADEMARK OFFICE

CERTIFICATE OF CORRECTION

PATENT NO. : 5,935,276

DATED : August 10, 1999

INVENTOR(S) : Thomas F. DeRosa, Joseph M. Russo, Benjamin J. Kaufman, James R. Ketcham It is certified that error appears in the above-identified patent and that said Letters Patent is hereby corrected as shown below:

In Column 4, line 60, before "-methylpolyvinylcyclohexane-b-" add --α--

In Column 6, line 55, delete poly[1,2-dihydroxy]; and add –poly[1,2-dihydroxyethane];--

In Column 11, line 17, delete $C_1$ and add --$C_2$--.

Signed and Sealed this

Twentieth Day of June, 2000

*Attest:*

Q. TODD DICKINSON

*Attesting Officer*

*Director of Patents and Trademarks*